US012297701B2

(12) United States Patent
Domanski et al.

(10) Patent No.: US 12,297,701 B2
(45) Date of Patent: May 13, 2025

(54) ADJUSTABLE DAMPER

(71) Applicant: Schlumberger Technology Corporation, Sugar Land, TX (US)

(72) Inventors: Nadia Domanski, Cheltenham (GB); Edward George Parkin, Whitminster (GB); Katie Kane, Islandmagee (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 16 days.

(21) Appl. No.: 18/240,050

(22) Filed: Aug. 30, 2023

(65) Prior Publication Data

US 2025/0075567 A1 Mar. 6, 2025

(51) Int. Cl.
*E21B 17/07* (2006.01)
*E21B 47/017* (2012.01)

(52) U.S. Cl.
CPC ..... *E21B 17/07* (2013.01); *E21B 47/017* (2020.05)

(58) Field of Classification Search
CPC ..... E21B 17/07; E21B 47/017
See application file for complete search history.

(56) References Cited

U.S. PATENT DOCUMENTS

2013/0216400 A1* 8/2013 Bucher ..... F04B 43/08 417/474
2023/0407712 A1* 12/2023 Reckmann ..... E21B 17/07

* cited by examiner

*Primary Examiner* — Catherine Loikith

(57) ABSTRACT

A device may include an interior component having an outer diameter (OD) surface. A device may include a protective housing positioned around at least a portion of the interior component and having an inner diameter (ID) surface proximate the OD surface of the interior component. A device may include an adjustable damper positioned between the ID surface and the OD surface and configured to change size in a transverse direction perpendicular to a longitudinal axis of the interior component.

13 Claims, 9 Drawing Sheets

ADJUSTABLE DAMPER

BACKGROUND

For drilling of a borehole, measurement and control components are positioned inside protective housings that allow pressure equalization or protection from debris and vibration in the downhole environment. Assembly of the components in the protective housing requires a strong connection to the housing during use while allowing clearance during assembly.

SUMMARY

In some aspects, the techniques described herein relate to a downhole tool including: an interior component having an outer diameter (OD) surface; a protective housing positioned around at least a portion of the interior component and having an inner diameter (ID) surface proximate the OD surface of the interior component; and an adjustable damper positioned between the ID surface and the OD surface and configured to change size in a transverse direction perpendicular to a longitudinal axis of the interior component.

In some aspects, the techniques described herein relate to a downhole tool including: an interior component having a rotational axis and an outer diameter (OD) surface in a radial direction relative to the rotational axis; and an adjustable damper fixed to the OD surface of the interior component with an expanded height in the radial direction of the interior component and a contraction distance in the radial direction of the interior component.

In some aspects, the techniques described herein relate to a method of assembling a downhole tool, the method including: actuating an adjustable damper positioned between an interior component and a protective housing in a radial direction relative to a longitudinal direction; and moving the interior component in the longitudinal direction relative to the protective housing.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 8-1 is a transverse cross-sectional view of another embodiment of an adjustable damper with angular piezoelectric segments, according to some embodiments of the present disclosure.

FIG. 8-2 is a longitudinal cross-sectional view of the embodiment of an adjustable damper of FIG. 8-1, according to some embodiments of the present disclosure.

DETAILED DESCRIPTION

Embodiments of the present disclosure generally relate to devices, systems, and methods for protecting sensitive components of a drill string or drilling assembly in a downhole environment. More particularly, the present disclosure relates to providing shock and vibration damping between an interior component of a drill string or drilling assembly and a protective housing. In some embodiments, at least one dimension of the shock damper is electrically adjustable to change a damper outer diameter (OD) of the interior component (including the shock damper) to ease assembly, disassembly, replacement, repair, or combinations thereof of the interior component within the inner diameter (ID) of the protective housing.

In some embodiments, a drill string includes a plurality of components coupled together to form a long assembly. In some embodiments, the drill string is rotated in the downhole environment to remove material from a target material, such as surrounding geological formation, a borehole casing, or another downhole tool. In some examples, the drill string can further contact and experience friction with the walls of the borehole or casing. The contact with the target material and/or contact with the borehole walls can apply torque to different longitudinal portions of the drill string, which can induce torsional oscillations and/or lateral vibrations along the drill string. In some embodiments, the shock, vibration, oscillations, or combinations thereof can damage downhole tools. Electronic components housed inside sections of the drill string may be susceptible to damage from shock, vibration, oscillations, or combinations thereof.

The energy imparted to the drill string can be damped, absorbed, or otherwise reduced by a damper positioned in the drill string at one or more locations. In some embodiments, the damper is positioned radially between an interior component and a protective housing relative to a rotational axis (e.g., longitudinal axis) of the drill string. In some embodiments, the damper includes one or more features that allow the damper to decrease in a radial dimension to provide clearance between the damper and the inner surface of the protective housing. In some embodiments, the damper includes a piezoelectric material that allows the damper to decrease in a radial dimension to provide clearance between the damper and the inner surface of the protective housing when an external electric field is applied to the piezoelectric material. In some embodiments, the damper is a piezoelectrical material. In some embodiments, the damper includes a piezoelectric material. In some embodiments, the damper includes a piezoelectric layer of piezoelectric material, such as a radial layer that moves a damping layer of damping material that is positioned radially outside of the piezoelectric layer.

Figure 1:
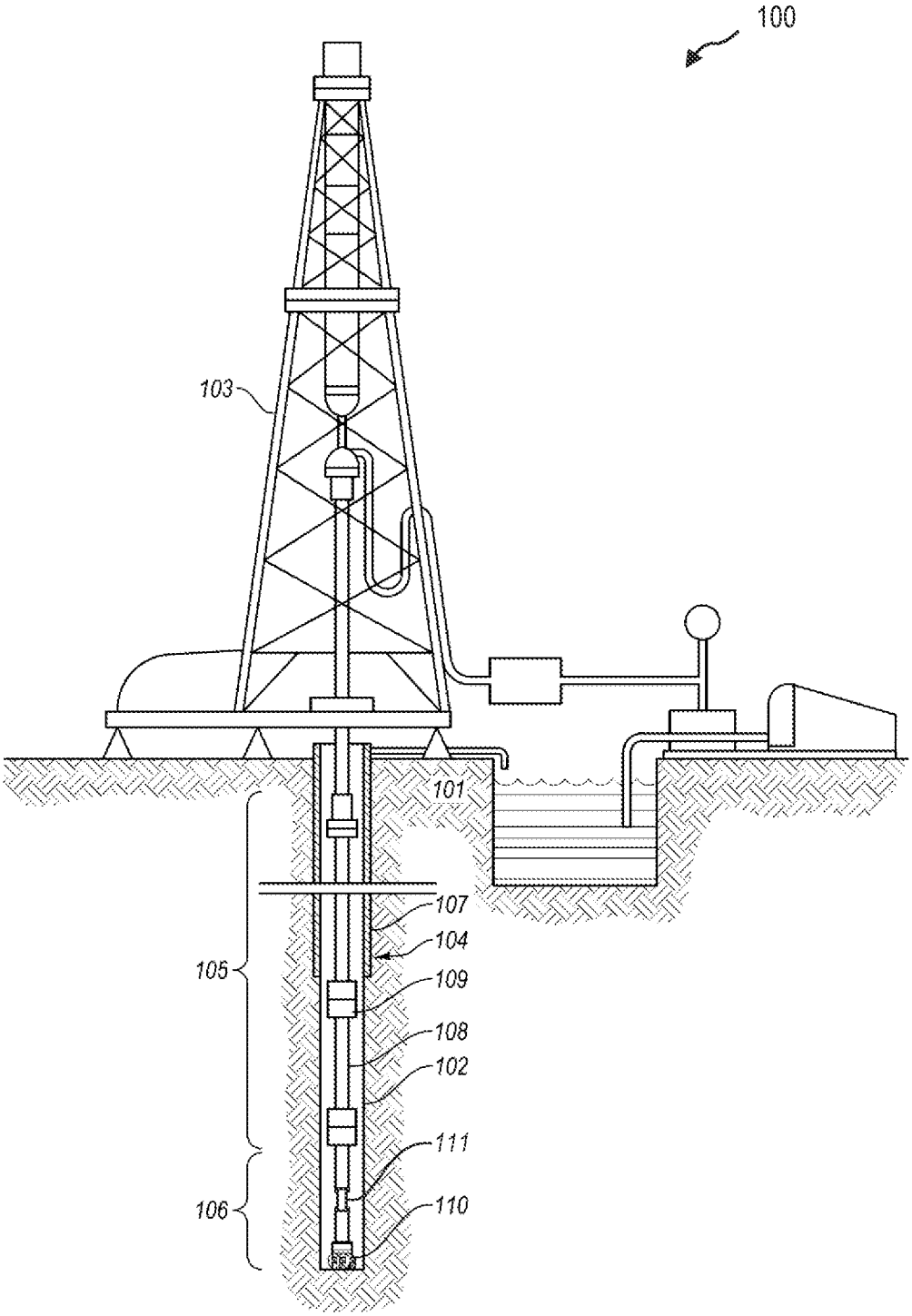
FIG. 1 illustrates an embodiment of a drilling system and downhole environment, according to some embodiments of the present disclosure.

FIG. 1 illustrates an embodiment of a drilling system and downhole environment. FIG. 1 shows one example of a drilling system 100 for drilling an earth formation 101 to form a wellbore 102. The drilling system 100 includes a drill rig 103 used to turn a drilling assembly 104 which extends downward into the wellbore 102. The drilling assembly 104 may include a drill string 105 and a bottomhole assembly (BHA) 106 attached to the downhole end of drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the wellbore 102 as it is being drilled, and for preventing the collapse of the wellbore 102. The drilling fluid 111 carries drill solids including drill fines, drill cuttings, and other swarf from the wellbore 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface by the drilling fluid 111 or may be allowed to fall downhole. The conditions of the equipment of the drilling system 100, the formation 101, the wellbore 102, the drilling fluid 111, or other part of the wellsite can change during operations.

Any portion of the drilling system 100 may experience shock and vibration during drilling and/or milling operations. In some embodiments, an adjustable damper is applicable to any portion of the drilling system 100. In some embodiments, the geometry and packaging of downhole tools, such as those in the BHA 106 and/or drill string 105 experience greater shock and vibration with less space to accommodate damping equipment. Embodiments of adjustable dampers according to the present disclosure are specifically described in relation to downhole tools, although other applications are contemplated herein.

Figure 2:
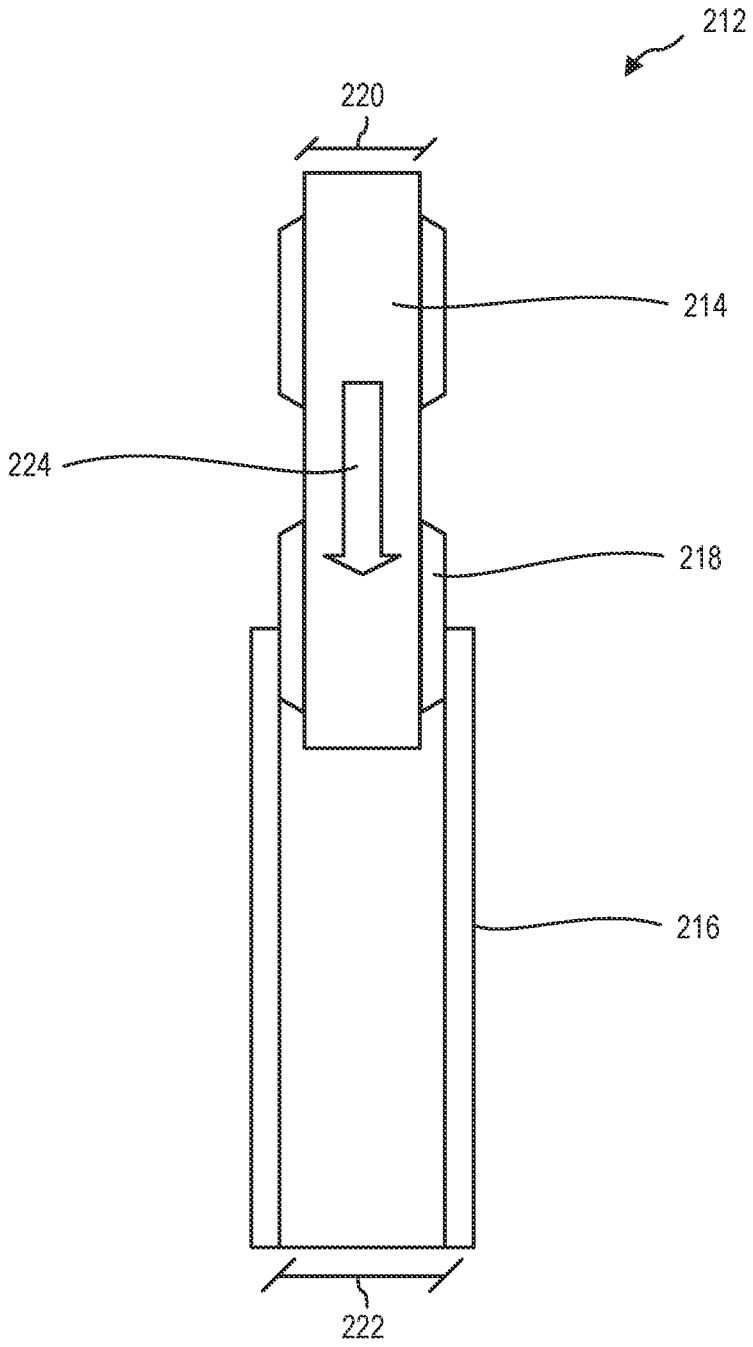
FIG. 2 is an embodiment of a downhole tool including an interior component and a protective housing, according to some embodiments of the present disclosure.

FIG. 2 is an embodiment of a downhole tool 212 including an interior component 214 and a protective housing 216. In some embodiments, the interior component 214 is or includes an electronic component of the drilling assembly. For example, an interior component is or includes a MWD tool, LWD tool, navigation tool, control tool, downhole motor, steering tool, communication tool, etc. In some embodiments, the interior component 214 is or includes a hydraulic component of the drilling assembly, such as a steering tool, hydraulic valve, turbine, etc.

In some embodiments, the protective housing 216 is a rigid housing that protects the interior component 214 from wear and impacts during drilling operations. In some embodiments, the protective housing 216 provides pressure equalization and/or pressurization of an interior volume of the housing 216 in which the interior component 214 is located. For example, in some embodiments, the protective housing 216 allows drilling fluid to flow into and/or through the protective housing 216 to equalize pressure inside and outside of the protective housing 216. In some embodiments, the protective housing 216 will not allow fluid flow through the protective housing 216, allowing the interior volume of the housing 216 in which the interior component 214 is located to be pressurized and/or maintained at a desired pressure.

The interior component 214 is supported in the protective housing 216 at least partially by the adjustable damper(s) 218. In some embodiments, the interior component 214 is supported radially by the adjustable damper(s) 218 within the protective housing 216. For example, the adjustable damper(s) 218 provides a compression force in a radial direction to limit and/or prevent movement of the interior component 214 relative to the protective housing 216 in the radial direction. In some embodiments, the interior component 214 is supported longitudinally by the adjustable damper(s) 218 within the protective housing 216. For example, the adjustable damper(s) 218 provides a friction force in a longitudinal direction to limit and/or prevent movement of the interior component 214 relative to the protective housing 216 in the longitudinal direction.

In some embodiments, the interior component 214 is inserted into the protective housing 216 during an assembly process (and removed from the protective housing 216 during a disassembly process) in the longitudinal direction. With a conventional damper, the damper compresses between the OD 220 of the interior component 214 and the ID 222 of the protective housing 216. To provide sufficient support, a conventional damper has a radial dimension greater than the gap between the OD 220 and the ID 222 to provide a compression force and/or friction force. To ensure sufficient contact surface, a conventional damper has a radial dimension greater than the gap between the OD 220 and the ID 222 to accommodate and/or compensate for variations and/or machining tolerances between the OD 220 and the ID 222. The downhole tool 212 is assembled by application of a longitudinal force 224 to the interior component 214 and/or the protective housing 216. In some embodiments, the longitudinal force 224 damages the interior component 214 and/or the protective housing 216.

In some embodiments, an adjustable damper 218 according to the present disclosure is adjustable in at least the radial direction to lessen or eliminate the longitudinal force 224 to assemble and/or disassemble the interior component 214 from the protective housing 216. In some embodiments, a radial height of the adjustable damper 218 decreases in a radial direction to lessen a friction force between the interior component 214 and the protective housing 216 that lessens the longitudinal force 224 needed to move the interior component 214 relative to the protective housing 216. In some embodiments, a height of the adjustable damper 218 decreases in a radial direction such that the damper 218 will not contact the ID 222 of the protective housing 216 during assembly/disassembly of the downhole tool 212.

In some embodiments, a method of assembly, disassembly, maintenance, repair, or combinations thereof of a downhole tool 212 includes actuating an adjustable damper 218 a contraction distance to reduce a radial height (e.g., damper OD) of the adjustable damper 218 and moving the interior component 214 and protective housing 216 longitudinally relative to one another. In some embodiments, actuating the adjustable damper a contraction distance includes applying an electric field to the adjustable damper. In some embodiments, actuating the adjustable damper a contraction distance includes removing an electric field from the adjustable damper.

The embodiment described in relation to FIG. 2 and some other embodiments described herein describe the adjustable damper as fixed to the interior component 214 and movable relative to the protective housing 216 during assembly/disassembly where the adjustable damper is configured to apply a radial compression force and/or friction force to the protective housing. It should be understood that, in some embodiments, an adjustable damper according to the present disclosure may be fixed to the ID of the protective housing to apply a radial compression force and/or friction force to the interior component. By changing in a radial height relative to the radial direction of the downhole tool 212, some embodiments of an adjustable damper can make assembly and/or disassembly faster, easier, and safer.

Figure 3:
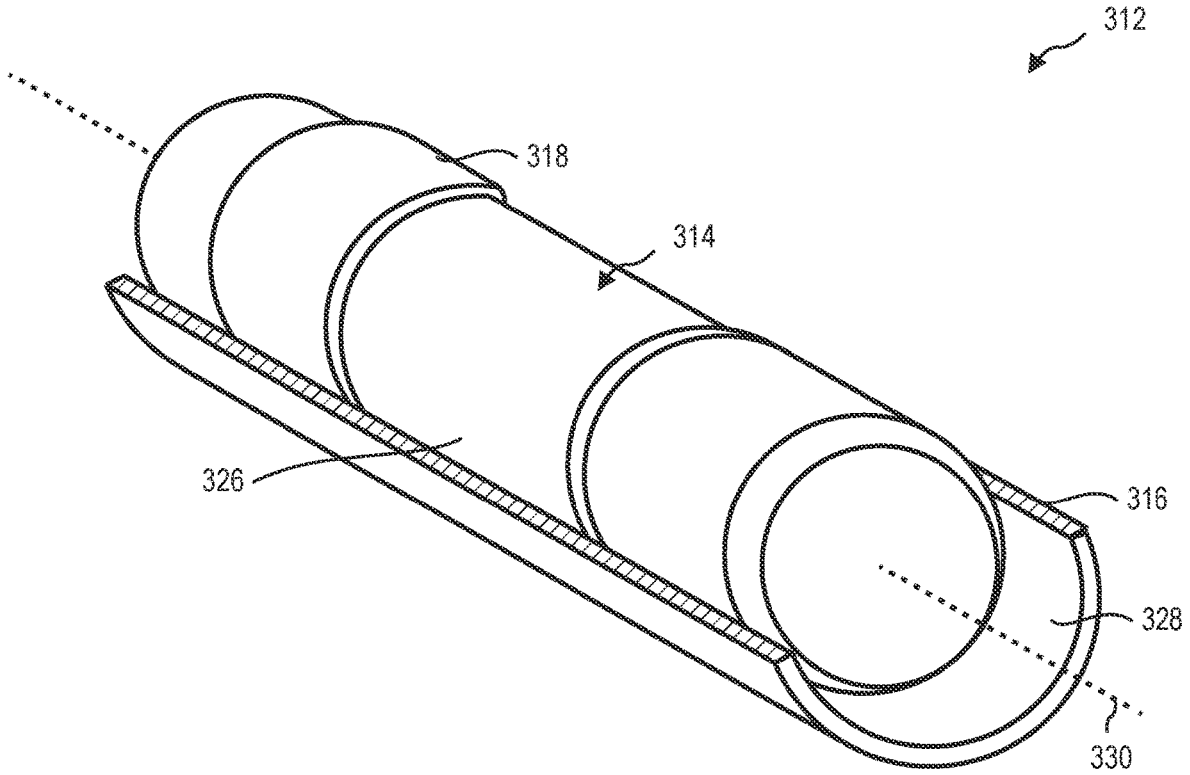
FIG. 3 is a perspective partial cutaway view of an embodiment of a downhole tool including adjustable dampers, according to some embodiments of the present disclosure.

FIG. 3 is a perspective partial cutaway view of an embodiment of a downhole tool 312 including adjustable dampers 318. In some embodiments, the adjustable damper 318 is positioned radially between the OD surface 326 of the interior component 314 and the ID surface 328 of the protective housing 316 relative to a rotational axis 330 of the downhole tool 312. In some embodiments, at least one adjustable damper 318 is located circumferentially around the interior component 314. In some examples, the adjustable damper 318 is substantially continuous around the entire circumference of the OD surface 326 of the interior component 314 between the interior component 314 and the protective housing 316 in at least one longitudinal position (e.g., in the longitudinal direction of the rotational axis 330). In some embodiments, the adjustable damper 318 provides a substantially continuous contact between an entire circumference of the OD surface 326 of the interior component 314 and an entire circumference of the ID surface 328 of the protective housing 316 in at least one longitudinal position (e.g., in the longitudinal direction of the rotational axis 330). In some examples, the continuous contact of the adjustable damper 318 around an entire circumference between the OD surface 326 and the ID surface 328 provides a fluid seal between the OD surface 326 and the ID surface 328.

Figure 4:
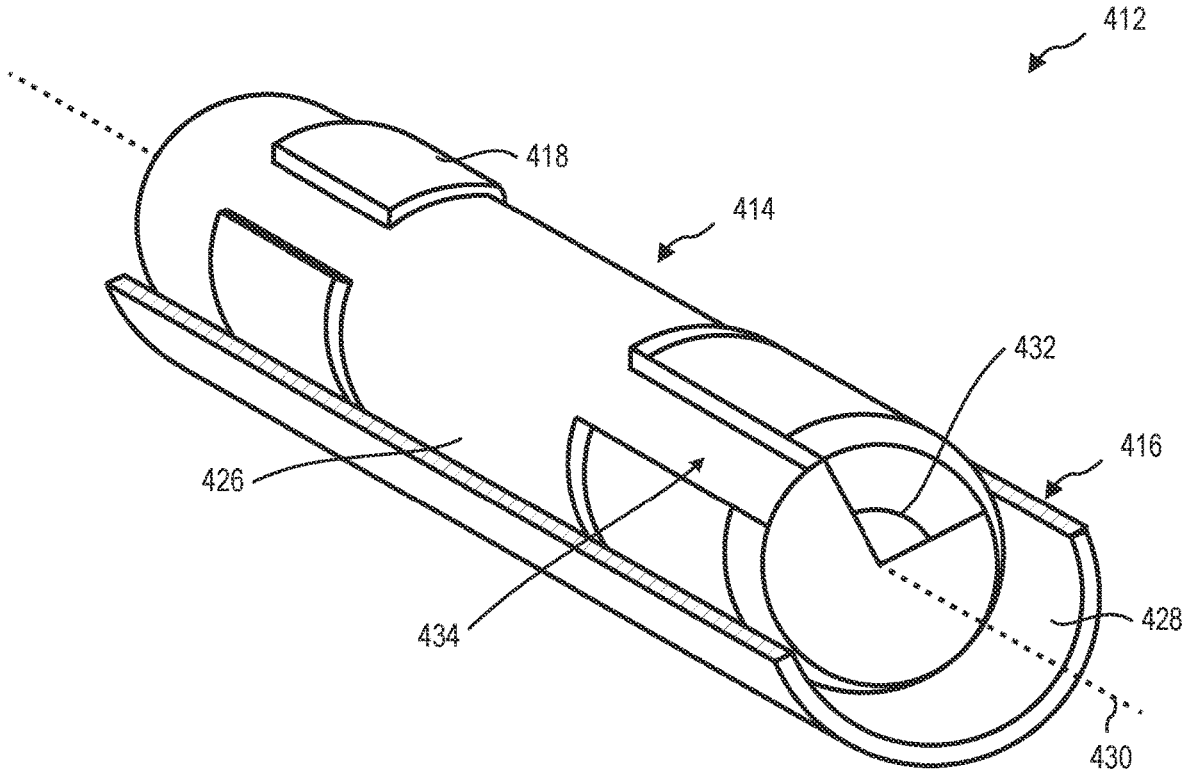
FIG. 4 is a perspective partial cutaway view of another embodiment of a downhole tool including non-circumferential adjustable dampers, according to some embodiments of the present disclosure.

FIG. 4 is a perspective partial cutaway view of another embodiment of a downhole tool 412 including non-circumferential adjustable dampers 418. In some embodiments, the adjustable damper 418 is positioned radially between a portion of the OD surface 426 of the interior component 414 and a portion of the ID surface 428 of the protective housing 416 relative to a rotational axis 430 of the downhole tool 412. In some embodiments, at least one adjustable damper 418 is located around an angular portion 432 of the OD surface 426 of the interior component 414 and the ID surface 428 of the protective housing 416. For example, at least one adjustable damper 418 is positioned in an angular portion 432 that is less than an entire circumference of the OD surface 426 of the interior component 414 and/or the ID surface 428 of the protective housing 416.

In some embodiments, a plurality of adjustable dampers 418 are positioned around a longitudinal portion of the interior component 414 with gaps 434 positioned angularly therebetween relative to the rotational axis 430 of the downhole tool 412. In some embodiments, the gaps 434 angularly between the adjustable dampers 418 allow fluid flow between the adjustable dampers 418.

Figure 5:
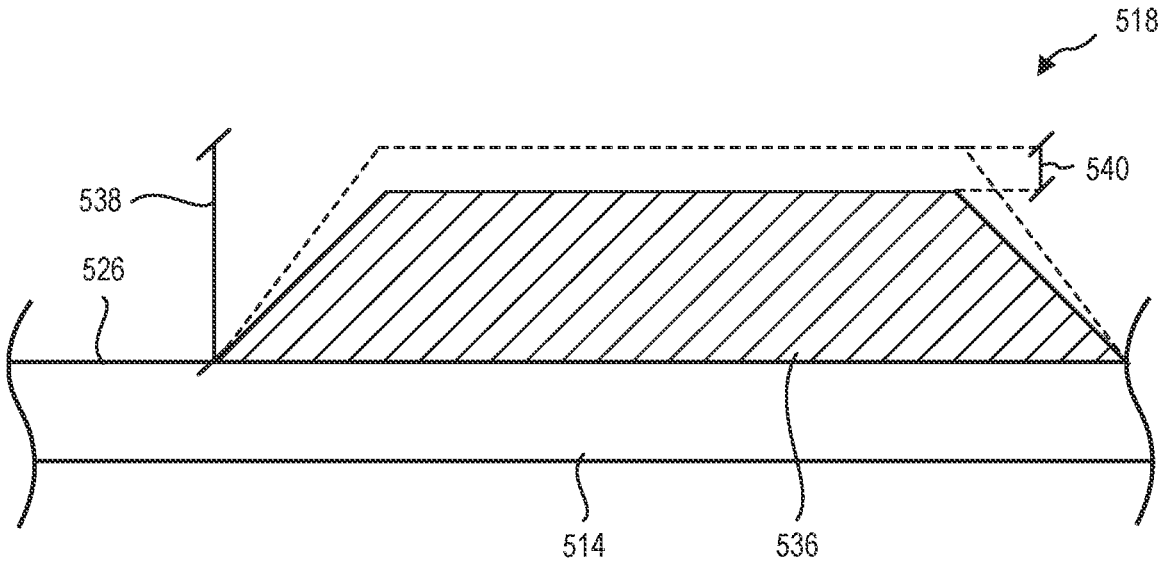
FIG. 5 is a longitudinal cross-sectional view of an embodiment of an adjustable damper including a piezoelectric material, according to some embodiments of the present disclosure.

FIG. 5 is a longitudinal cross-sectional view of an embodiment of an adjustable damper 518 including a piezoelectric material. In some embodiments, the adjustable damper 518 is or includes a piezoelectric material in a piezoelectric layer 536. The piezoelectric layer 536 has an expanded height 538 in a radial direction beyond the OD surface 526 of the interior component 514. In some embodiments, the expanded height 538 is the height of the adjustable damper 518 in the absence of an external electric field applied to the piezoelectric material of the piezoelectric layer 536. In some embodiments, the expanded height 538 is the height of the adjustable damper 518 in the presence of an external electric field applied to the piezoelectric material of the piezoelectric layer 536.

In some embodiments, the expanded height 538 of the adjustable damper 518 is in a range having an upper value, a lower value, or upper and lower values including any of 1.0 millimeters (mm), 1.5 mm, 2.0 mm, 2.5 mm, 3.0 mm, 3.5 mm, 5 mm, 10 mm, 30 mm, 60 mm, or any values therebetween. In some embodiments, the expanded height 538 is greater than 1.0 mm. In some embodiments, the expanded height 538 is less than 60 mm. In some embodiments, the expanded height 538 is between 1.5 mm and 30 mm. In some embodiments, the expanded height 538 is between 2.0 mm and 3.0 mm. In some embodiments, the expanded height 538 is approximately 2.5 mm.

In some embodiments, the adjustable damper 518 has a contraction distance 540 in which the radial height of the adjustable damper 518 decreases from the expanded height 538. In some embodiments, the contraction distance 540 is based at least partially on the strength of the external electric field applied to the piezoelectric material of the piezoelectric layer 536. In some embodiments, the contraction distance 540 is a distance in a range having an upper value, a lower value, or upper and lower values including any of 0.025 mm, 0.05 mm, 0.1 mm, 0.2 mm, 0.3 mm, 0.4 mm, 0.5 mm, 0.75 mm, 1.0 mm, or any values therebetween. In some embodiments, the contraction distance 540 is greater than 0.025 mm. In some embodiments, the contraction distance 540 is less than 1.0 mm. In some embodiments, the contraction distance 540 is between 0.025 mm and 1.0 mm. In some embodiments, the contraction distance 540 is between 0.1 mm and 0.5 mm. In some embodiments, the contraction distance 540 is approximately 0.25 mm.

Figure 6:
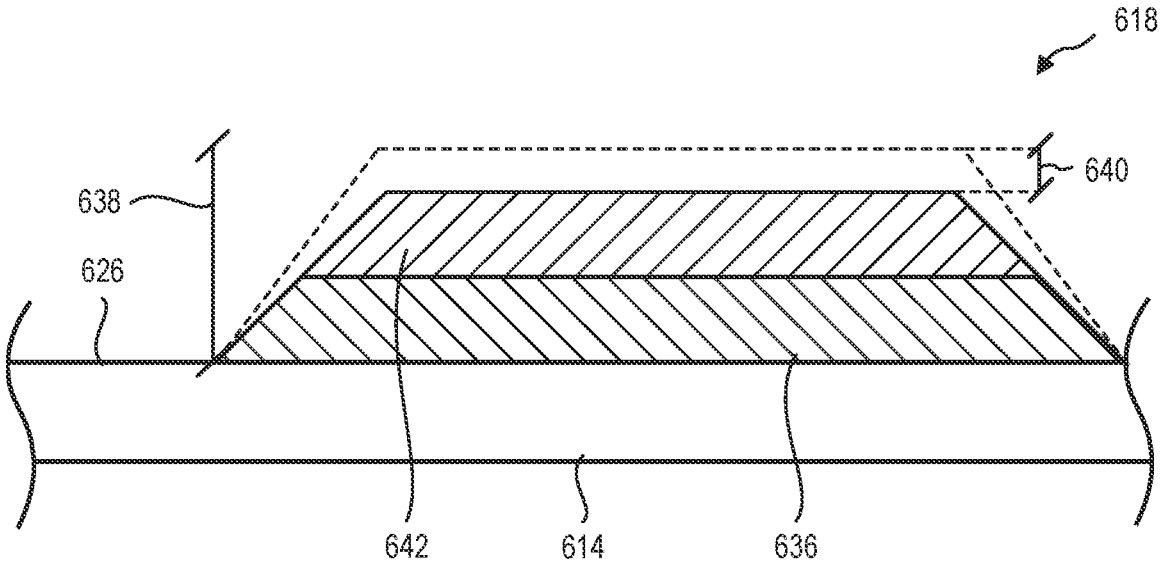
FIG. 6 is a longitudinal cross-sectional view of an embodiment of an adjustable damper including a piezoelectric material and a non-piezoelectric material, according to some embodiments of the present disclosure.

FIG. 6 is a longitudinal cross-sectional view of an embodiment of an adjustable damper 618 including a piezoelectric material and a non-piezoelectric material. In some embodiments, the adjustable damper 618 includes a piezoelectric material in a piezoelectric layer 636. In some embodiments, the adjustable damper 618 includes a damper material or other non-piezoelectric material in a damper layer 642. In some embodiments, the damper layer 642 is radially outside (e.g., further from the OD surface 626 of the interior component 614) of the piezoelectrical layer 636. In some embodiments, the damper layer 642 is radially inside of the piezoelectrical layer 636. The adjustable damper 618 has an expanded height 638 in a radial direction beyond the OD surface 626 of the interior component 614. In some embodiments, the expanded height 638 is the height of the adjustable damper 618 in the absence of an external electric field applied to the piezoelectric material of the piezoelectric layer 636. In some embodiments, the expanded height 638 is the height of the adjustable damper 618 in the presence of an external electric field applied to the piezoelectric material of the piezoelectric layer 636.

In some embodiments, the expanded height 638 of the adjustable damper 618 is in a range having an upper value, a lower value, or upper and lower values including any of 1.0 millimeters (mm), 1.5 mm, 2.0 mm, 2.5 mm, 3.0 mm, 3.5 mm, 5 mm, 10 mm, 30 mm, 60 mm, or any values therebetween. In some embodiments, the expanded height 638 is greater than 1.0 mm. In some embodiments, the expanded height 638 is less than 60 mm. In some embodiments, the expanded height 638 is between 1.5 mm and 30 mm. In some embodiments, the expanded height 638 is between 2.0 mm and 3.0 mm. In some embodiments, the expanded height 638 is approximately 2.5 mm.

In some embodiments, the adjustable damper 618 has a contraction distance 640 in which the radial height of the adjustable damper 618 decreases from the expanded height 638 based at least partially on changes to at least one dimension of the piezoelectric layer 636. In some embodiments, the contraction distance 640 is based at least partially on the strength of the external electric field applied to the piezoelectric material of the piezoelectric layer 636. In some embodiments, the contraction distance 640 is a distance in a range having an upper value, a lower value, or upper and lower values including any of 0.1 millimeter (mm), 0.2 mm, 0.3 mm, 0.4 mm, 0.5 mm, 0.75 mm, 1.0 mm, or any values therebetween. In some embodiments, the contraction distance 640 is greater than 0.1 mm. In some embodiments, the contraction distance 640 is less than 1.0 mm. In some embodiments, the contraction distance 640 is between 0.1 mm and 1.0 mm. In some embodiments, the contraction distance 640 is between 0.2 mm and 0.5 mm. In some embodiments, the contraction distance 640 is approximately 0.3 mm.

Figure 7:
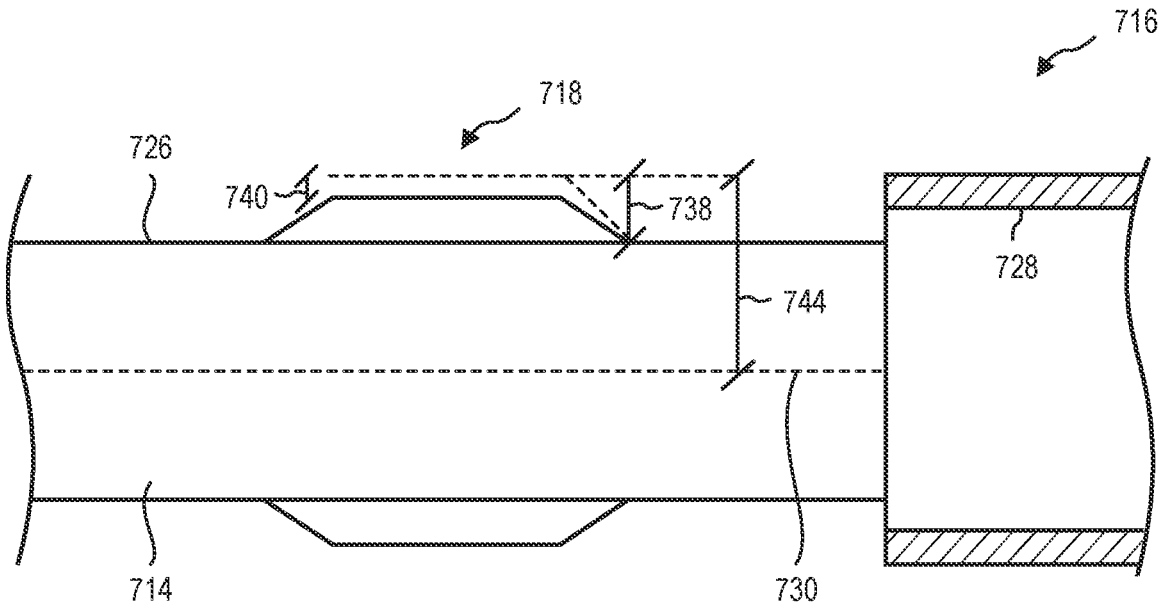
FIG. 7 is a side view of an embodiment of a downhole tool illustrating a radial height change of an adjustable damper relative to a protective housing, according to some embodiments of the present disclosure.

FIG. 7 is a side view of an embodiment of a downhole tool illustrating a radial height change of an adjustable damper 718 relative to a protective housing 716. In some embodiments, the expanded height 738 of the adjustable damper 718 outside of the OD surface 726 defines a damper OD 744 relative to a rotational axis 730 of the interior component 714. In some embodiments, the damper OD 744 is greater than an ID of the ID surface 728 of the protective housing 716.

In some embodiments, the expanded radial height 738 is proportional to the damper OD 744. In some embodiments, the expanded radial height 738 is a percentage of the damper OD 744 of the adjustable damper 718 in a range having an upper value, a lower value, or upper and lower values of 3%, 4%, 5%, 6%, 7%, 8%, or any other values therebetween. In some embodiments, the expanded radial height 738 is greater than 3% of the damper OD 744. In some embodiments, the expanded radial height 738 is less than 8% of the damper OD 744. In some embodiments, the expanded radial height 738 is between 3% and 8% of the damper OD 744. In some embodiments, the expanded radial height 738 is between 4% and 7% of the damper OD 744. In some embodiments, the expanded radial height 738 is between 5% and 6% of the damper OD 744. In at least one example, the expanded radial height 738 is approximately 3.5 mm and the damper OD 744 is 61.2 mm.

In some embodiments, the contraction distance 740 is proportional to the damper OD 744. In some embodiments, the contraction distance 740 is a percentage of the damper OD 744 of the adjustable damper 718 in a range having an upper value, a lower value, or upper and lower values of 0.3%, 0.4%, 0.5%, 0.6%, 0.7%, 0.8%, or any other values therebetween. In some embodiments, the contraction distance 740 is greater than 0.3% of the damper OD 744. In some embodiments, the contraction distance 740 is less than 0.8% of the damper OD 744. In some embodiments, the contraction distance 740 is between 0.3% and 0.8% of the damper OD 744. In some embodiments, the contraction distance 740 is between 0.4% and 0.7% of the damper OD 744. In some embodiments, the contraction distance 740 is between 0.45% and 0.55% of the damper OD 744. In at least one example, the contraction distance 740 is approximately 0.3 mm and the damper OD 744 is 61.2 mm.

Figures 1, 8:
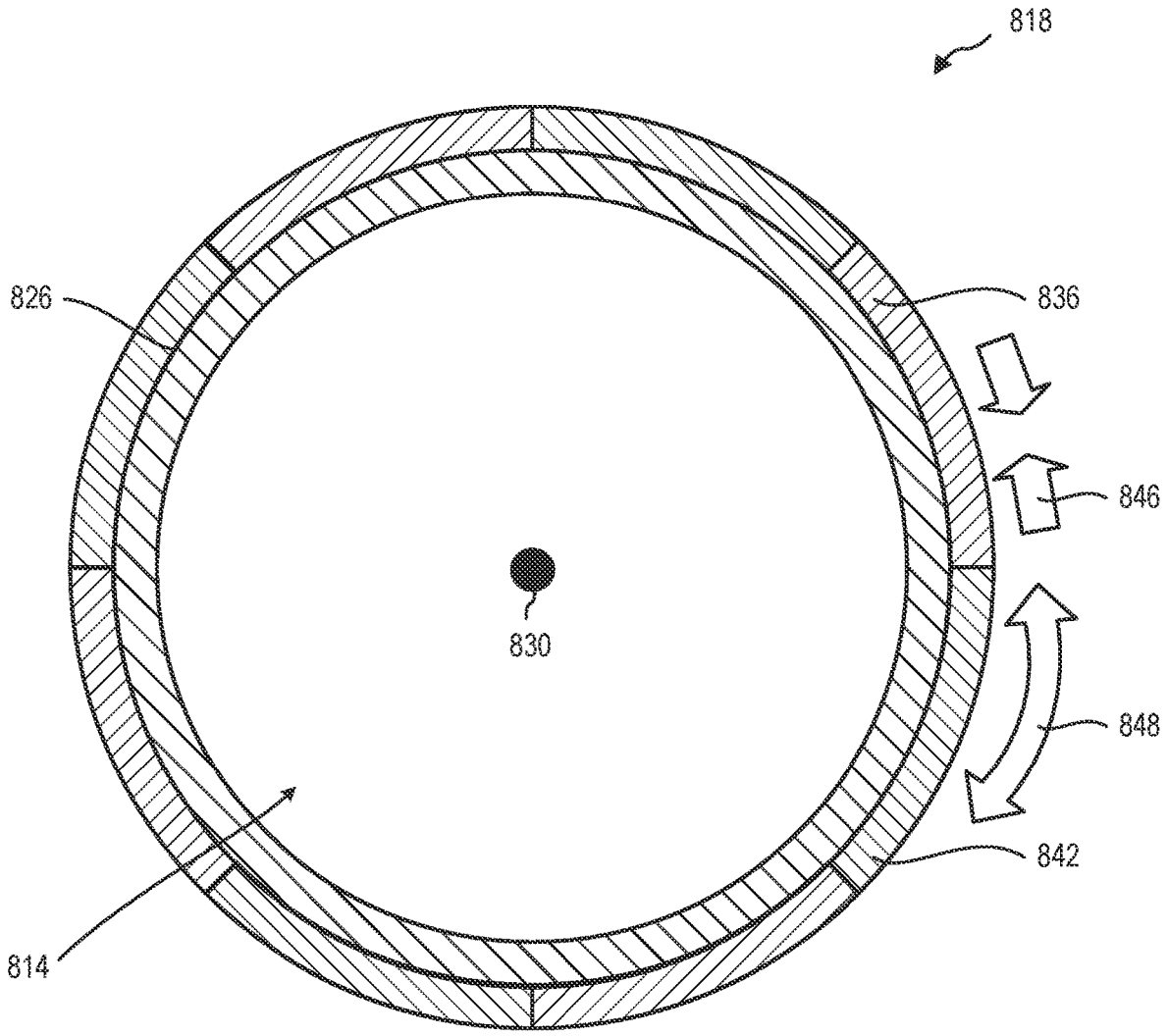
Figures 2, 8:
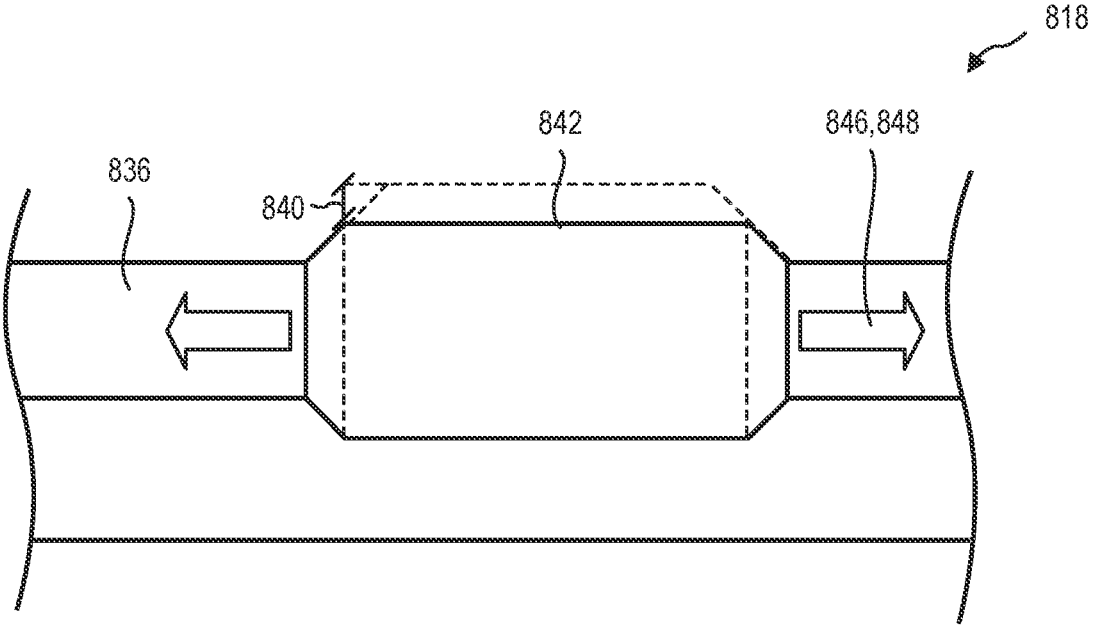

FIG. 8-1 is a transverse cross-sectional view of an embodiment of an adjustable damper 818 with piezoelectric segments. In some embodiments, the adjustable damper 818 is positioned around at least a portion of a circumference of the OD surface 826 of the interior component 814 (or an ID surface of a protective housing). In some embodiments, the adjustable damper 818 includes at least one piezoelectric layer 836 and at least one damper layer 842 positioned angularly adjacent to one another relative to the rotational axis 830.

In some embodiments, the adjustable damper 818 changes in size in at least one dimension based on changes in a dimension of the at least one piezoelectric layer 836. For example, application of an external electric field to a piezoelectric layer 836 causes a compression force 846 of the piezoelectric layer 836 and a resultant tension force 848 on the damper layer 842. In some embodiments, the damper layer 842 decreases in a radial height relative to the rotational axis 830.

FIG. 8-2 is a detail transverse cross-sectional view of the embodiment of an adjustable damper 818 with piezoelectric segments of FIG. 8-1. In some embodiments, the compression force 846 of the piezoelectric layer 836 applies a tension force 848 to the damper layer 842. In some embodiments, the tension force 848 increases a size of the angular dimension of the damper layer 842. In some embodiments, stretching the damper layer 842 in the angular direction produces an associated decrease in a radial height of the damper layer 842. The contraction distance 840 of the damper layer 842 and/or the adjustable damper 818 is, in some embodiments, a contraction distance 840 of any damper layer and/or the adjustable damper described herein, such as those embodiments described in relation to FIG. 5, 6, or 7.

Figure 9:
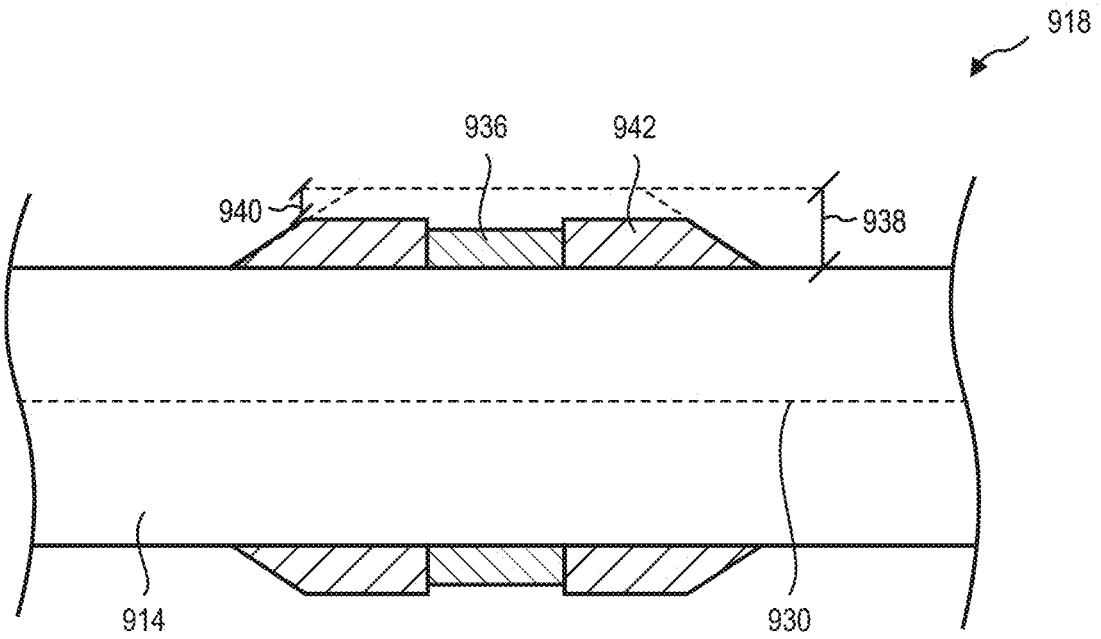
FIG. 9 is a longitudinal cross-sectional view of another embodiment of an adjustable damper with piezoelectric segments, according to some embodiments of the present disclosure.

FIG. 9 is a longitudinal cross-sectional view of another embodiment of an adjustable damper 918 with piezoelectric segments. In some embodiments, piezoelectrical layer(s) 936 and the damper layer(s) 942 are adjacent to and connected to one another in a longitudinal direction (e.g., in a direction of the rotational axis 930 of the interior component 914). In some embodiments, a change in at least one dimension of the piezoelectric layer(s) 936 causes a force on the damper layer(s) 942, which, in turn, causes a change to the expanded height 938 of the adjustable damper 918. In some embodiments, the contraction distance 940 is sufficient to decrease or eliminate a friction force between the interior component 914 and a protective housing.

The present disclosure relates generally to devices, systems, and methods for protecting sensitive components of a drill string or drilling assembly in a downhole environment. More particularly, the present disclosure relates to providing shock damping between an interior component of a drill string or drilling assembly and a protective housing. In some embodiments, at least one dimension of the shock damper is electrically adjustable to change an OD of the interior component to ease assembly, disassembly, replacement, repair, or combinations thereof of the interior component within the ID of the protective housing.

In some embodiments, a drill string includes a plurality of components coupled together to form a long assembly. In some embodiments, the drill string is rotated in the downhole environment to remove material from a target material, such as surrounding geological formation, a borehole casing, or another downhole tool. In some examples, the drill string can further contact and experience friction with the walls of the borehole or casing. The contact with the target material and/or contact with the borehole walls can apply torque to different longitudinal portions of the drill string, which can induce torsional oscillations and/or lateral vibrations along the drill string. In some embodiments, the shock, vibration, oscillations, or combinations thereof can damage downhole tools. Electronic components housed inside sections of the drill string may be susceptible to damage from shock, vibration, oscillations, or combinations thereof.

The energy imparted to the drill string can be damped, absorbed, or otherwise reduced by a damper positioned in the drill string at one or more locations. In some embodiments, the damper is positioned radially between an interior component and a protective housing relative to a rotational axis (e.g., longitudinal axis) of the drill string. In some embodiments, the damper includes one or more features that allow the damper to decrease in a radial dimension to provide clearance between the damper and the inner surface of the protective housing. In some embodiments, the damper includes a piezoelectric material that allows the damper to decrease in a radial dimension to provide clearance between the damper and the inner surface of the protective housing when an external electric field is applied to the piezoelectric material. In some embodiments, the damper is a piezoelectrical material. In some embodiments, the damper includes a piezoelectric material. In some embodiments, the damper includes a piezoelectric layer of piezoelectric material, such as a radial layer that moves a damping layer of damping material that is positioned radially outside of the piezoelectric layer.

In some embodiments, a downhole tool includes an interior component and a protective housing. In some embodiments, the interior component is or includes an electronic component of the drilling assembly. For example, an interior component is or includes a MWD tool, LWD tool, navigation tool, control tool, downhole motor, steering tool, communication tool, etc. In some embodiments, the interior component is or includes a hydraulic component of the drilling assembly, such as a steering tool, hydraulic valve, turbine, etc.

In some embodiments, the protective housing is a rigid housing that protects the interior component from wear and impacts during drilling operations. In some embodiments, the protective housing provides pressure equalization and/or pressurization of an interior volume of the housing in which the interior component is located. For example, in some embodiments, the protective housing allows drilling fluid to flow into and/or through the protective housing to equalize pressure inside and outside of the protective housing. In some embodiments, the protective housing will not allow fluid flow through the protective housing, allowing the interior volume of the housing in which the interior component is located to be pressurized and/or maintained at a desired pressure.

The interior component is supported in the protective housing at least partially by the adjustable damper(s). In some embodiments, the interior component is supported radially by the adjustable damper(s) within the protective housing. For example, the adjustable damper(s) provides a compression force in a radial direction to limit and/or prevent movement of the interior component relative to the protective housing in the radial direction. In some embodiments, the interior component is supported longitudinally by the adjustable damper(s) within the protective housing. For example, the adjustable damper(s) provides a friction force in a longitudinal direction to limit and/or prevent movement of the interior component relative to the protective housing in the longitudinal direction.

In some embodiments, the interior component is inserted into the protective housing during an assembly process (and removed from the protective housing during a disassembly process) in the longitudinal direction. With a conventional damper, the damper compresses between the OD of the interior component and the ID of the protective housing. To provide sufficient support, a conventional damper has a radial dimension greater than the gap between the OD and the ID to provide a compression force and/or friction force. To ensure sufficient contact surface, a conventional damper has a radial dimension greater than the gap between the OD and the ID to accommodate and/or compensate for variations and/or machining tolerances between the OD and the ID. The downhole tool is assembled by application of a longitudinal force to the interior component and/or the protective housing. In some embodiments, the longitudinal force damages the interior component and/or the protective housing.

In some embodiments, an adjustable damper according to the present disclosure is adjustable in at least the radial direction to lessen or eliminate the longitudinal force to assemble and/or disassemble the interior component from the protective housing. In some embodiments, a height of the adjustable damper decreases in a radial direction to lessen the longitudinal force needed to move the interior component relative to the protective housing. In some embodiments, a height of the adjustable damper decreases in a radial direction such that the damper will not contact the ID of the protective housing during assembly/disassembly of the downhole tool.

In some embodiments, a method of assembly, disassembly, maintenance, repair, or combinations thereof of a downhole tool includes actuating an adjustable damper a contraction distance to reduce a radial height (e.g., damper OD) of the adjustable damper and moving the interior component and protective housing longitudinally relative to one another. In some embodiments, actuating the adjustable damper a contraction distance includes applying an electric field to the adjustable damper. In some embodiments, actuating the adjustable damper a contraction distance includes removing an electric field from the adjustable damper.

The embodiment described above, and some other embodiments described herein describe the adjustable damper as fixed to the interior component and movable relative to the protective housing during assembly/disassembly where the adjustable damper is configured to apply a radial compression force and/or friction force to the protective housing. It should be understood that, in some embodiments, an adjustable damper according to the present disclosure may be fixed to the ID of the protective housing to apply a radial compression force and/or friction force to the interior component. By changing in a radial height relative to the radial direction of the downhole tool, some embodiments of an adjustable damper can make assembly and/or disassembly faster, easier, and safer.

In some embodiments, the adjustable damper is positioned radially between the OD surface of the interior component and the ID surface of the protective housing relative to a rotational axis of the downhole tool. In some embodiments, at least one adjustable damper is located circumferentially around the interior component. In some examples, the adjustable damper is substantially continuous around the entire circumference of the OD surface of the interior component between the interior component and the protective housing in at least one longitudinal position (e.g., in the longitudinal direction of the rotational axis). In some embodiments, the adjustable damper provides a substantially continuous contact between an entire circumference of the OD surface of the interior component and an entire circumference of the ID surface of the protective housing in at least one longitudinal position (e.g., in the longitudinal direction of the rotational axis). In some examples, the continuous contact of the adjustable damper around an entire circumference between the OD surface and the ID surface provides a fluid seal between the OD surface and the ID surface.

In some embodiments, the adjustable damper is positioned radially between a portion of the OD surface of the interior component and a portion of the ID surface of the protective housing relative to a rotational axis of the downhole tool. In some embodiments, at least one adjustable damper is located around an angular portion of the OD surface of the interior component and the ID surface of the protective housing. For example, at least one adjustable damper is positioned in an angular portion that is less than an entire circumference of the OD surface of the interior component and/or the ID surface of the protective housing.

In some embodiments, a plurality of adjustable dampers is positioned around a longitudinal portion of the interior component with gaps positioned angularly therebetween relative to the rotational axis of the downhole tool. In some embodiments, the gaps angularly between the adjustable dampers allow fluid flow between the adjustable dampers.

In some embodiments, the adjustable damper is or includes a piezoelectric material in a piezoelectric layer. The piezoelectric layer has an expanded height in a radial direction beyond the OD surface of the interior component. In some embodiments, the expanded height is the height of the adjustable damper in the absence of an external electric field applied to the piezoelectric material of the piezoelectric layer. In some embodiments, the expanded height is the height of the adjustable damper in the presence of an external electric field applied to the piezoelectric material of the piezoelectric layer.

In some embodiments, the expanded height of the adjustable damper is in a range having an upper value, a lower value, or upper and lower values including any of 1.0 millimeters (mm), 1.5 mm, 2.0 mm, 2.5 mm, 3.0 mm, 3.5 mm, 5 mm, 10 mm, 30 mm, 60 mm, or any values therebetween. In some embodiments, the expanded height is greater than 1.0 mm. In some embodiments, the expanded height is less than 60 mm. In some embodiments, the expanded height is between 1.5 mm and 30 mm. In some embodiments, the expanded height is between 2.0 mm and 3.0 mm. In some embodiments, the expanded height is approximately 2.5 mm.

In some embodiments, the adjustable damper has a contraction distance in which the radial height of the adjustable damper decreases from the expanded height. In some embodiments, the contraction distance is based at least partially on the strength of the external electric field applied to the piezoelectric material of the piezoelectric layer. In some embodiments, the contraction distance is a distance in a range having an upper value, a lower value, or upper and lower values including any of 0.025 mm, 0.05 mm, 0.1 mm, 0.2 mm, 0.3 mm, 0.4 mm, 0.5 mm, 0.75 mm, 1.0 mm, or any values therebetween. In some embodiments, the contraction distance 540 is greater than 0.025 mm. In some embodiments, the contraction distance is less than 1.0 mm. In some embodiments, the contraction distance is between 0.025 mm and 1.0 mm. In some embodiments, the contraction distance is between 0.1 mm and 0.5 mm. In some embodiments, the contraction distance is approximately 0.25 mm.

In some embodiments, the adjustable damper includes a piezoelectric material in a piezoelectric layer. In some embodiments, the adjustable damper includes a damper material or other non-piezoelectric material in a damper layer. In some embodiments, the damper layer is radially outside (e.g., further from the OD surface of the interior component) of the piezoelectrical layer. In some embodiments, the damper layer is radially inside of the piezoelectrical layer. The adjustable damper has an expanded height in a radial direction beyond the OD surface of the interior component. In some embodiments, the expanded height is the height of the adjustable damper in the absence of an external electric field applied to the piezoelectric material of the piezoelectric layer. In some embodiments, the expanded height is the height of the adjustable damper in the presence of an external electric field applied to the piezoelectric material of the piezoelectric layer.

In some embodiments, the expanded height of the adjustable damper is in a range having an upper value, a lower value, or upper and lower values including any of 1.0 millimeters (mm), 1.5 mm, 2.0 mm, 2.5 mm, 3.0 mm, 3.5 mm, 5 mm, 10 mm, 30 mm, 60 mm, or any values therebetween. In some embodiments, the expanded height is greater than 1.0 mm. In some embodiments, the expanded height is less than 60 mm. In some embodiments, the expanded height is between 1.5 mm and 30 mm. In some embodiments, the expanded height is between 2.0 mm and 3.0 mm. In some embodiments, the expanded height is approximately 2.5 mm.

In some embodiments, the adjustable damper has a contraction distance in which the radial height of the adjustable damper decreases from the expanded height based at least partially on changes to at least one dimension of the piezoelectric layer. In some embodiments, the contraction distance is based at least partially on the strength of the external electric field applied to the piezoelectric material of the piezoelectric layer. In some embodiments, the contraction distance is a distance in a range having an upper value, a lower value, or upper and lower values including any of 0.1 millimeter (mm), 0.2 mm, 0.3 mm, 0.4 mm, 0.5 mm, 0.75 mm, 1.0 mm, or any values therebetween. In some embodiments, the contraction distance is greater than 0.1 mm. In some embodiments, the contraction distance is less than 1.0 mm. In some embodiments, the contraction distance is between 0.1 mm and 1.0 mm. In some embodiments, the contraction distance is between 0.2 mm and 0.5 mm. In some embodiments, the contraction distance is approximately 0.3 mm.

In some embodiments, the expanded height of the adjustable damper outside of the OD surface of the interior component defines a damper OD relative to a rotational axis of the interior component. In some embodiments, the damper OD is greater than an ID of the ID surface of the protective housing.

In some embodiments, the expanded radial height is proportional to the damper OD. In some embodiments, the expanded radial height is a percentage of the damper OD of the adjustable damper in a range having an upper value, a lower value, or upper and lower values of 3%, 4%, 5%, 6%, 7%, 8%, or any other values therebetween. In some embodiments, the expanded radial height is greater than 3% of the damper OD. In some embodiments, the expanded radial height is less than 8% of the damper OD. In some embodiments, the expanded radial height is between 3% and 8% of the damper OD. In some embodiments, the expanded radial height is between 4% and 7% of the damper OD. In some embodiments, the expanded radial height is between 5% and 6% of the damper OD. In at least one example, the expanded radial height is approximately 3.5 mm and the damper OD is 61.2 mm.

In some embodiments, the contraction distance is proportional to the damper OD. In some embodiments, the contraction distance is a percentage of the damper OD of the adjustable damper in a range having an upper value, a lower value, or upper and lower values of 0.3%, 0.4%, 0.5%, 0.6%, 0.7%, 0.8%, or any other values therebetween. In some embodiments, the contraction distance is greater than 0.3% of the damper OD. In some embodiments, the contraction distance is less than 0.8% of the damper OD. In some embodiments, the contraction distance is between 0.3% and 0.8% of the damper OD. In some embodiments, the contraction distance is between 0.4% and 0.7% of the damper OD. In some embodiments, the contraction distance is between 0.45% and 0.55% of the damper OD. In at least one example, the contraction distance is approximately 0.3 mm and the damper OD is 61.2 mm.

In some embodiments, the adjustable damper is positioned around at least a portion of a circumference of the OD surface of the interior component (or an ID surface of a protective housing). In some embodiments, the adjustable damper includes at least one piezoelectric layer and at least one damper layer positioned angularly adjacent to one another relative to the rotational axis.

In some embodiments, the adjustable damper changes in size in at least one dimension based on changes in a dimension of the at least one piezoelectric layer. For example, application of an external electric field to a piezoelectric layer causes a compression force of the piezoelectric layer and a resultant tension force on the damper layer. In some embodiments, the damper layer decreases in a radial height relative to the rotational axis.

In some embodiments, the compression force of the piezoelectric layer applies a tension force to the damper layer. In some embodiments, the tension force increases a size of the angular dimension of the damper layer. In some embodiments, stretching the damper layer in the angular direction produces an associated decrease in a radial height of the damper layer. The contraction distance of the damper layer and/or the adjustable damper is, in some embodiments, a contraction distance of any damper layer and/or the adjustable damper described herein, such as those embodiments described herein.

In some embodiments, piezoelectrical layer(s) and the damper layer(s) are adjacent to and connected to one another in a longitudinal direction (e.g., in a direction of the rotational axis of the interior component). In some embodiments, a change in at least one dimension of the piezoelectric layer(s) causes a force on the damper layer(s), which, in turn, causes a change to the expanded height of the adjustable damper. In some embodiments, the contraction distance is sufficient to decrease or eliminate a friction force between the interior component and a protective housing.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A downhole tool comprising:

an interior component having an outer diameter (OD) surface;

a protective housing positioned around at least a portion of the interior component and having an inner diameter (ID) surface proximate the OD surface of the interior component;

an adjustable damper including a piezoelectric layer positioned between the ID surface and the OD surface and configured to change size in a transverse direction perpendicular to a longitudinal axis of the interior component; and wherein the piezoelectric layer and a damper layer are angularly adjacent to one another relative to a rotational axis of the downhole tool and the piezoelectric layer applies a tension force to the damper layer to change at least one dimension of the damper layer.

2. The downhole tool of claim 1, wherein the longitudinal axis is the rotational axis and the transverse direction is a radial direction.

3. The downhole tool of claim 1, wherein the adjustable damper has a damper OD in the transverse direction greater than an ID of the ID surface.

4. The downhole tool of claim 1, wherein the piezoelectric layer is closer to the OD surface than the damper layer.

5. The downhole tool of claim 1, wherein the piezoelectric layer and the damper layer surround a circumference of the OD surface of the interior component.

6. The downhole tool of claim 1, wherein the adjustable damper is fixed to the OD surface of the interior component.

7. The downhole tool of claim 1, wherein the adjustable damper forms a fluid seal between the interior component and the protective housing.

8. The downhole tool of claim 1, wherein the adjustable damper includes a plurality of angular portions, with angular gaps therebetween, between the interior component and the protective housing relative to a rotational axis of the downhole tool.

9. The downhole tool of claim 1, wherein the adjustable damper is fixed to the ID surface of the protective housing.

10. The downhole tool of claim 1, wherein the adjustable damper has a contraction distance greater than 0.025 millimeters.

11. The downhole tool of claim 1, wherein the adjustable damper has a contraction distance greater than 0.3% of a damper OD of the adjustable damper and interior component relative to a rotational axis of the downhole tool.

12. The downhole tool of claim 1, wherein the adjustable damper has an expanded height greater than 1.5 millimeters.

13. The downhole tool of claim 1, wherein the adjustable damper has an expanded height greater than 3% of a damper OD of the adjustable damper and interior component relative to the rotational axis of the downhole tool.

* * * * *